US011904427B2

(12) United States Patent
Novovic et al.

(10) Patent No.: US 11,904,427 B2
(45) Date of Patent: Feb. 20, 2024

(54) ABRASIVE MACHINING

(71) Applicant: ROLLS-ROYCE plc, London (GB)

(72) Inventors: Donka Novovic, Birmingham (GB); Dragos A Axinte, Nottingham (GB); Alessio Spampinato, Nottingham (GB)

(73) Assignee: ROLLS-ROYCE plc, London (GB)

( * ) Notice: Subject to any disclaimer, the term of this patent is extended or adjusted under 35 U.S.C. 154(b) by 1104 days.

(21) Appl. No.: 16/712,782

(22) Filed: Dec. 12, 2019

(65) Prior Publication Data

US 2020/0215659 A1 Jul. 9, 2020

(30) Foreign Application Priority Data

Jan. 7, 2019 (GB) ..... 1900161

(51) Int. Cl.

| | |
|---|---|
| ***B24B 19/00*** | (2006.01) |
| ***B24B 53/017*** | (2012.01) |
| ***B24B 53/06*** | (2006.01) |
| ***B24B 53/14*** | (2006.01) |
| ***B24D 5/06*** | (2006.01) |
| ***B24D 18/00*** | (2006.01) |

(52) U.S. Cl.

CPC ..... *B24B 19/009* (2013.01); *B24B 53/017* (2013.01); *B24B 53/06* (2013.01); *B24B 53/14* (2013.01); *B24D 5/06* (2013.01); *B24D 18/0009* (2013.01); *B24D 2203/00* (2013.01)

(58) Field of Classification Search

CPC ..... B24B 19/009; B24B 53/017; B24B 53/06; B24B 53/14; B24D 5/06; B24D 18/0009

See application file for complete search history.

(56) References Cited

U.S. PATENT DOCUMENTS

| | | | | |
|---|---|---|---|---|
| 5,370,944 | A * | 12/1994 | Omori | C23C 30/005 428/548 |
| 9,050,706 | B2 | 6/2015 | Wiand et al. | |
| 2009/0221212 | A1* | 9/2009 | Palushaj | A46D 1/0238 451/28 |

FOREIGN PATENT DOCUMENTS

| | | | |
|---|---|---|---|
| CN | 203817993 | U | 9/2014 |
| EP | 3 415 275 | A2 | 12/2018 |
| WO | 2017/209747 | A1 | 12/2017 |

OTHER PUBLICATIONS

Jul. 1, 2020 Extended Search Report issued in European Patent Application No. 19214805.4.

Jun. 24, 2019 Search Report issued in British Patent Application No. 1900161.9.

* cited by examiner

*Primary Examiner* — Pegah Parvini

(74) *Attorney, Agent, or Firm* — Oliff PLC

(57) ABSTRACT

A method of manufacturing a rotary abrasive machining tool, the rotary abrasive machining tool including a hub and a plurality of abrasive segments mounted to the hub, the method including the steps of: mounting each abrasive segment on the hub; machining an abrading edge on each abrasive segment while the abrasive segment is mounted on the hub.

23 Claims, 18 Drawing Sheets

ABRASIVE MACHINING

This disclosure claims the benefit of UK Patent Application No. GB 1900161.9, filed on 7 Jan. 2019, which is hereby incorporated herein in its entirety.

TECHNICAL FIELD

This disclosure relates to apparatus for rotary abrasive machining.

BACKGROUND

The mechanisms of abrasive machining are known. One well-established abrasive machining technique is grinding, which is practiced with rotary abrasive machining tools known as grinding wheels. Grinding wheels are formed so as to have a tool profile that is the inverse of the desired profile of the component. As grinding wheels wear through use, there comes a point where the tool profile needs restoring, which is achieved using a process known as dressing. Rotary abrasive machining tools known as rotary dressers are used for this operation. It will therefore be understood that reference herein to a "rotary abrasive machining tool" therefore extends to grinding wheels, rotary dressing tools, and indeed to other forms of such machining tools.

Conventional rotary abrasive machining tools typically have abrasive surfaces with stochastic characteristics. In practice, this means that the abrasive elements in the surfaces have non-uniform spacing and varying degrees of protrusion from the surface. This can lead to poor extraction of material from the workpiece (the component being ground in the case of grinding, or the grinding wheel in the case of dressing) and thus loading of the rotary abrasive machining tool, reducing efficiency and increasing friction. Moreover, in profiled configurations, accelerated wear is experienced by the abrasive surface in critical profile regions.

SUMMARY

The present disclosure aims to at least partially address some of the above problems.

According to an aspect of the disclosure there is provided a method of manufacturing a rotary abrasive machining tool, the rotary abrasive machining tool comprising a hub and a plurality of abrasive segments mounted to the hub, the method comprising the steps of:

mounting each abrasive segment on the hub;

machining an abrading edge on each abrasive segment while said abrasive segment is mounted on the hub.

Optionally, the method further comprises, prior to mounting each abrasive segment on the hub:

obtaining a blank of material for each abrasive segment;

forming the abrasive segment from the blank.

Optionally, the abrading edge comprises a plurality of abrasive elements.

Optionally, the abrading edge has a profile upon which each one of the plurality of abrasive elements lies; and each one of the plurality of abrasive elements has an abrading surface that is parallel to the profile of the abrading edge at the location of the respective abrasive element.

Optionally, each one of the plurality of abrasive elements has an abrading surface, and there is a constant distance between the centres of the abrading surfaces.

Optionally, the abrasive elements on adjacent abrasive segments are axially offset in relation to each other.

Optionally, the abrading edge of each one of the plurality of abrasive segments has one of: the same profile; or one of a plurality of different profiles.

Optionally, the profile of the abrading edge follows one of: a straight path; or a curved path, e.g. in two dimensions, or a three-dimensional profiled path.

Optionally, the abrasive segment comprises an abrasive material of: cubic boron nitride; or diamond.

Optionally, the abrasive segment comprises a substrate on which the abrasive material is provided. Optionally, the substrate material is tungsten carbide.

Optionally, the forming of the abrasive segment from the blank is one of: electrical discharge machining; pulsed laser ablation; or water jet cutting.

Optionally, the machining of the abrasive edge is one of: pulsed laser ablation; electrical discharge machining; or water jet cutting.

Optionally, the hub has a plurality of axially-oriented radial slots in the outer circumference thereof; and the step of mounting each abrasive segment on the hub comprises locating each abrasive segment in a slot in the hub.

Optionally, one abrasive segment is mounted in each slot. Alternatively, a plurality of abrasive segments are mounted in each slot.

Optionally, the slots and the abrasive segments comprise corresponding protrusions and recesses configured to engage with each other.

Optionally, the abrasive segments are retained in the slots by flanges attached either side of the hub. Alternatively, the abrasive segments are retained in the slots by fastening strips attached either side of the abrasive segments. Optionally, the fastening strips are U-shaped, and arranged to surround each abrasive segment on three sides, two sides facing axially and one side facing circumferentially.

Alternatively, the hub comprises a cylindrical outer surface.

Whether the hub is slotted or cylindrical, optionally, the abrasive segments are mounted on the hub via a permanent fixing process. Optionally the fixing process is one of: brazing, or adhesive bonding.

BRIEF DESCRIPTION OF THE DRAWINGS

The disclosure will now be described by way of example only with reference to the accompanying drawings, which are purely schematic and not to scale, and in which.

DETAILED DESCRIPTION

Figure 1:
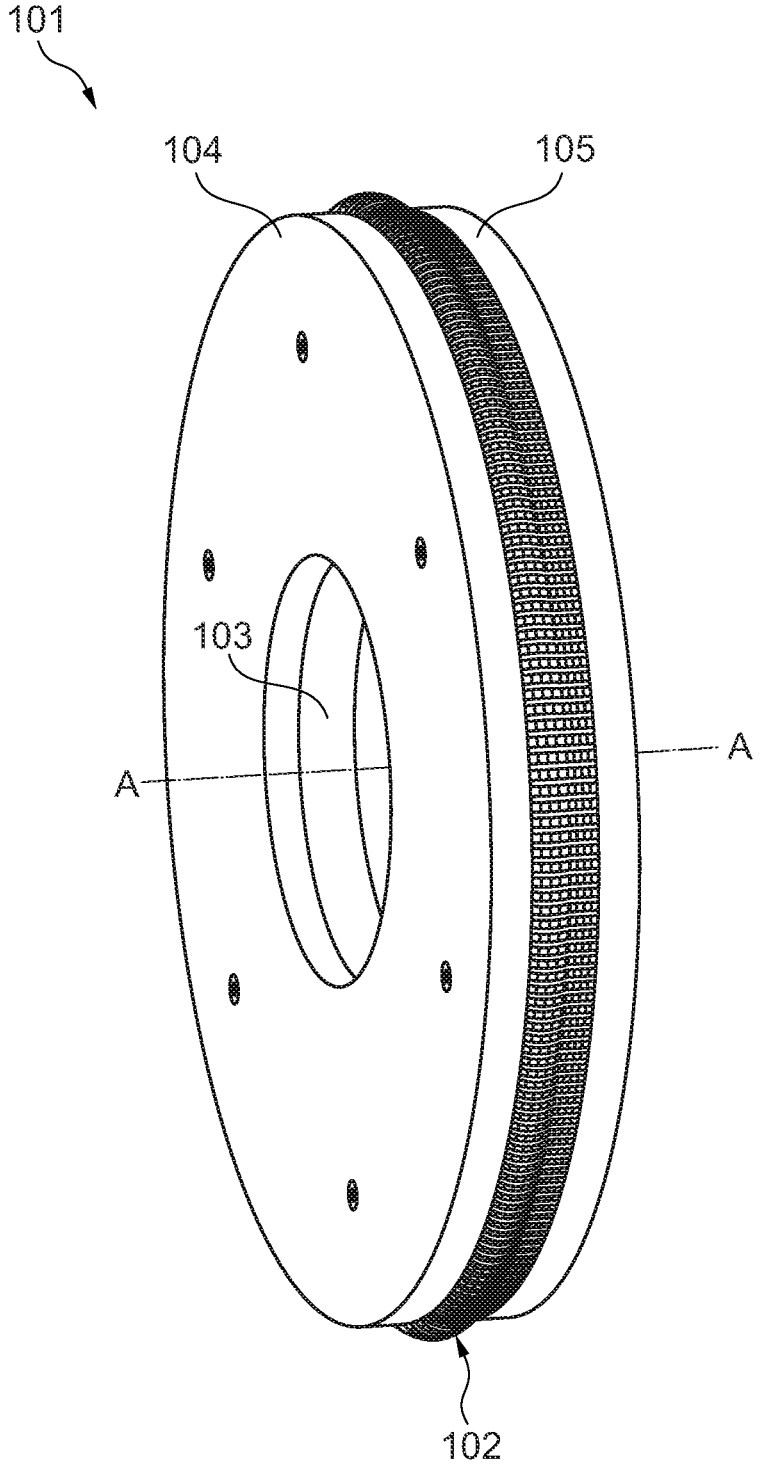
FIG. 1 shows a first example of a rotary abrasive machining tool according to the present disclosure, in the form of a rotary dressing tool.

A first example of a rotary abrasive machining tool according to an aspect of the present disclosure is shown in FIG. 1. In the illustrated example, the rotary abrasive machining tool is a rotary dressing tool 101. However, it will be appreciated that the rotary abrasive machining tool could instead be configured as a grinding wheel or any other form of such a tool.

The rotary dressing tool 101 is generally of annular form for location upon a rotary dressing machine, and thus has a rotational axis A-A. The rotary dressing tool 101 comprises an abrading surface 102 concentric around on a hub 103, both of which are sandwiched between a first flange 104 and a second flange 105. This is only one example, other examples without flanges are possible.

In use, the rotary dressing tool 101 is mounted upon a shaft of a rotary dresser machine whereupon it may facilitate dressing of a grinding wheel. In an alternative example, in which the rotary dressing tool 101 is instead a grinding wheel, it would be mounted upon a shaft of a grinding machine to facilitate grinding of a component.

Figure 2:
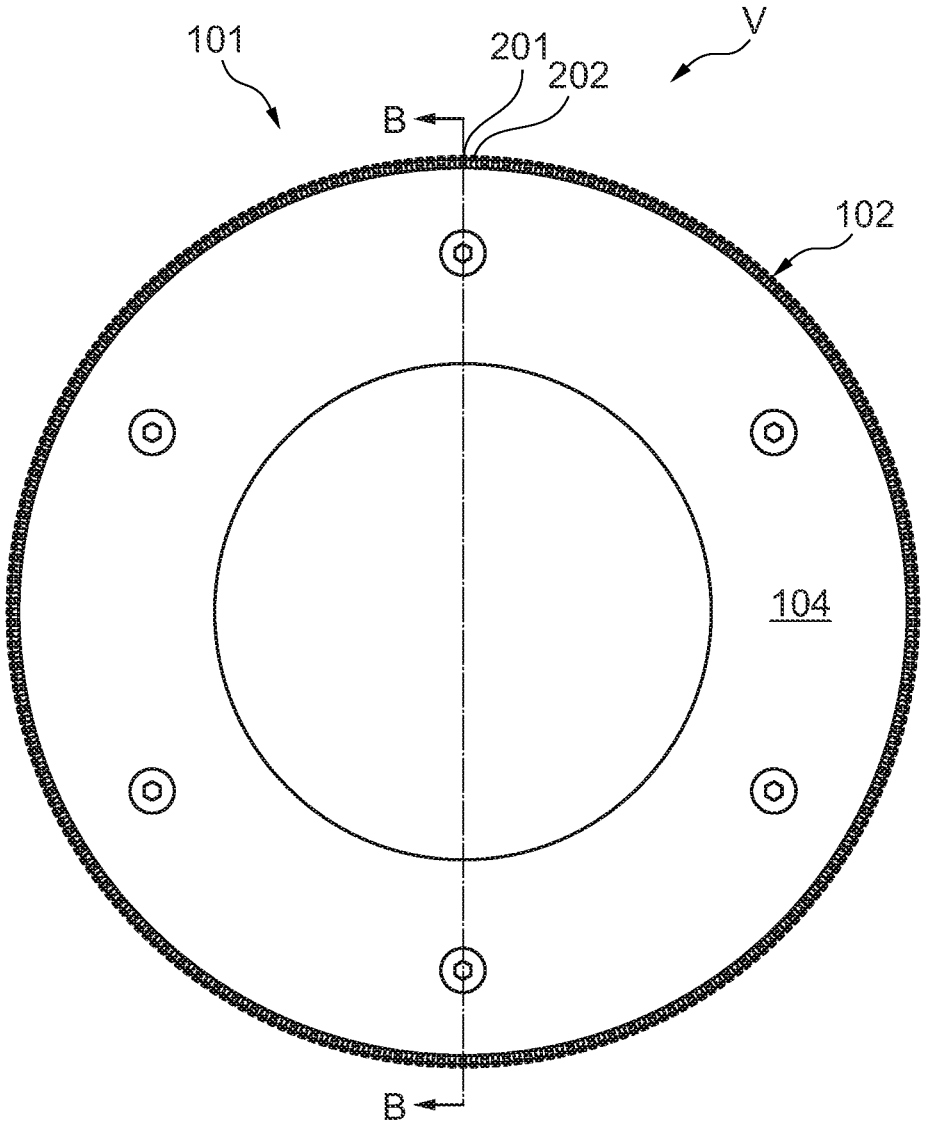
FIG. 2 shows the rotary dressing tool of FIG. 1 in plan view.
Figure 3:
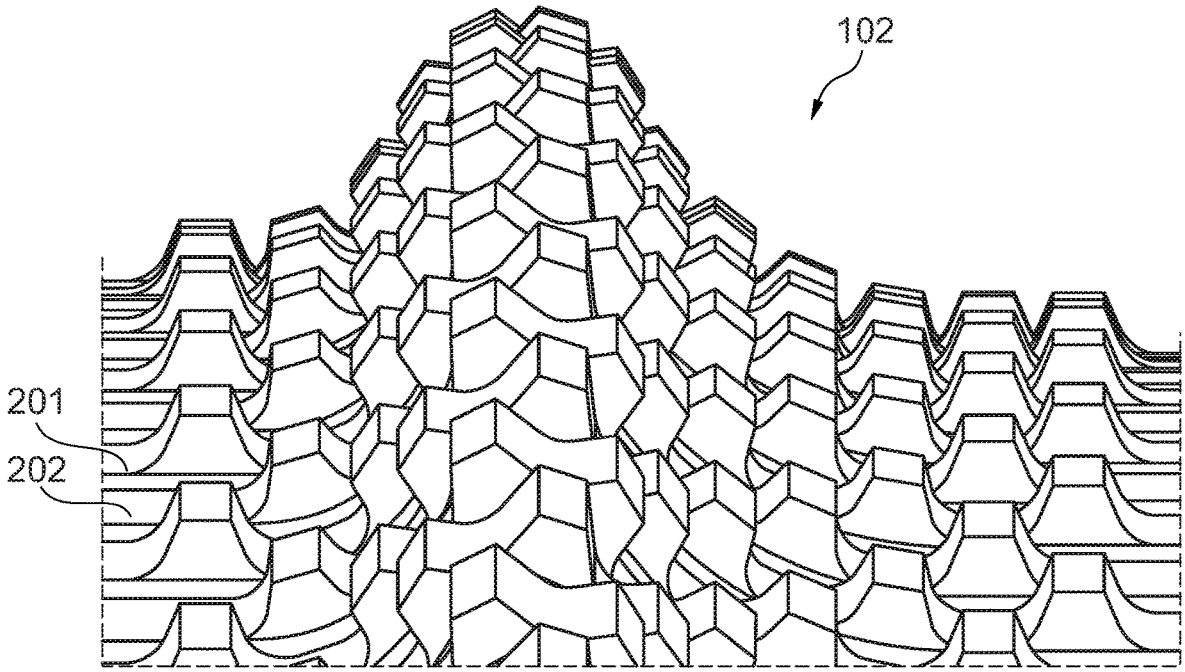
FIG. 3 shows a view of the abrading surface of the example rotary dressing tool at V of FIG. 2.

The rotary dressing tool 101 is shown in plan view in FIG. 2, whilst FIG. 3 shows a view of the abrading surface 102 at V of FIG. 2.

As may be seen, the abrading surface 102 is provided by a plurality of abrasive segments, such as a first abrasive segment 201 and a second abrasive segment 202.

Figure 4A:
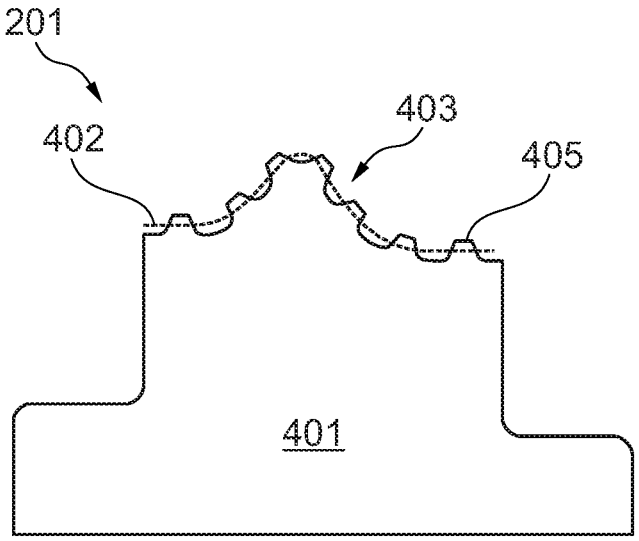
FIGS. 4A and 4B show, respectively, a first abrasive segment and a second abrasive segment.
Figure 4B:
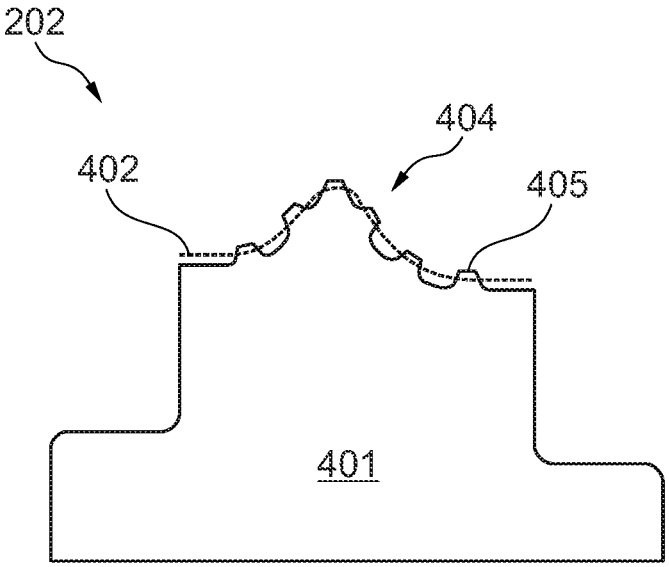

The first abrasive segment 201 is shown in isolation in FIG. 4A, and the second abrasive segment 202 is shown in isolation in FIG. 4B.

Each abrasive segment includes a tab 401 for mounting the abrasive segment in the hub 103. In the present example, the tab 401 is wider at its base than at its upper portion, the purpose of which will be described with reference to FIGS. 5 and 6.

Referring again to FIGS. 4A and 4B, each abrasive segment comprises a respective abrading edge 403 and 404. Both abrading edges share a profile 402, illustrated using a dashed line. However, as may be seen in the Figures, in the present example the geometry of the abrading edges 403, 404 on each abrasive segment differs slightly. The abrading edge 403 defines a plurality of abrasive elements 405 that are offset in relation to the plurality of abrasive elements 405 defined by the abrading edge 404. The offset between the abrasive elements is, with respect to the rotary dressing tool 101, an axial offset. In this specific example, the degree of offset is such that the abrasive elements on the abrading edge 403 line up with the gaps between the abrasive elements on the abrading edge 404, and vice versa.

The abrasive elements 405 defined by the abrading edges 403, 404 each have an abrading surface 406, each of which is parallel to the profile 403 at the location of the respective abrasive element 405.

Referring to FIG. 3, it may be seen that the abrading surface 102 of the present example is formed by a plurality of alternating first and second abrasive segments 201 and 202. This, combined with the axially offset relationship between the abrasive elements 405, allows control of debris flow, precise profile achievement and controlled wear of cutting edges during dressing or grinding operations.

In alternative examples, the offset between the abrasive elements 405 on the different abrasive segments may be controlled so as to provide different patterns on the abrading surface 102, such as staggered or wave patterns. More than two types of abrasive segments may be combined depending upon the pattern required. The freedom afforded by the present disclosure to use different combinations of abrasive segments thus allows the abrading surface 102 to be configured in any desired manner. Indeed, examples are envisaged in which abrasive segments are provided that have different profiles, as well as or as an alternative to different distributions of abrading elements on the abrading edge. Abrading patterns may also be generated on side of the abrasive elements.

By using a controlled high precision machining process, many different shapes and sizes for the abrasive elements 405 may be chosen, which may be distributed in any desired manner along a defined profile. The geometry of the abrasive elements 405 may be the same or different upon each abrasive segment. Further, the segments may be asymmetric so as to achieve different dressing or grinding characteristics in dependence upon rotation direction, for example.

The way in which the abrasive segments are mounted in the rotary dressing tool 101 will be described further with reference to FIGS. 5 to 7, whilst their configuration will be described further with reference to FIGS. 8 and 9.

Figure 5:
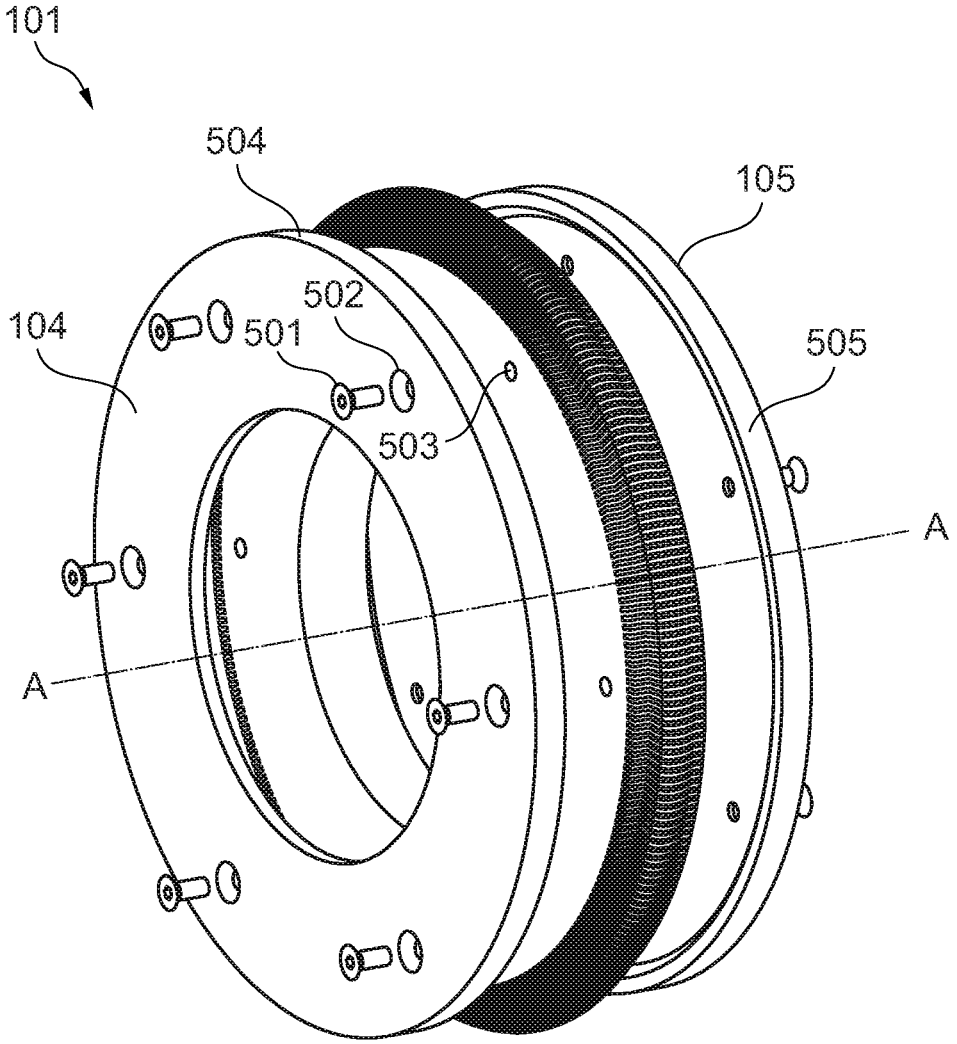
FIG. 5 shows the rotary dressing tool of FIG. 1 exploded along the axis A-A.
Figure 6:
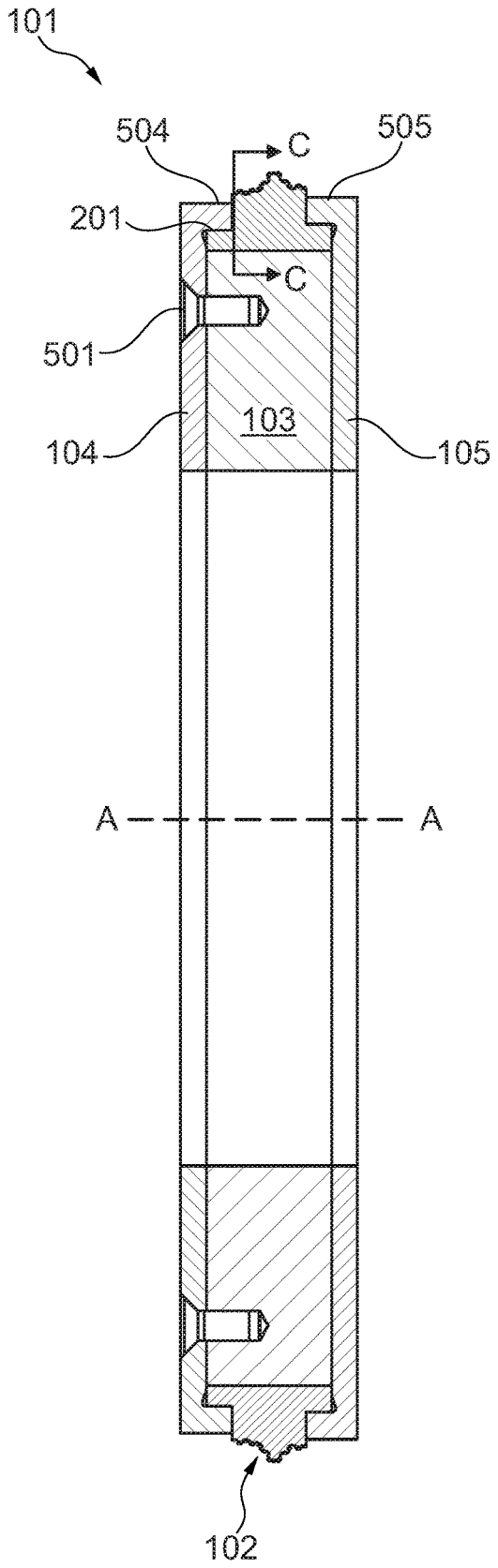
FIG. 6 shows a section of the rotary dressing tool along B-B of FIG. 2.

A view of the rotary dressing tool 101 exploded along the axis A-A is shown in FIG. 5, and a section of the rotary dressing tool 101 along B-B of FIG. 2 is shown in FIG. 6.

The flanges 104 and 105 are attached to the hub 103 by way of screws, such as screw 501. The screws pass through apertures in the flanges, such as aperture 502 in the flange 104, and are received in threaded holes in the hub 103, such as hole 503. The flanges 104 and 105 each include a respective circumferential rim 504 and 505.

Referring to FIGS. 4A and 4B, it will be noted that in the present example the tab 401 includes a base that is wider than its upper part. Referring again to FIGS. 5 and 6, when the flanges 104 and 105 are placed against the hub 103, the rims 504 and 505 co-operate with the wider base of the tab 401 to prevent radial and/or axial movement of the abrasive segments.

Figure 7A:
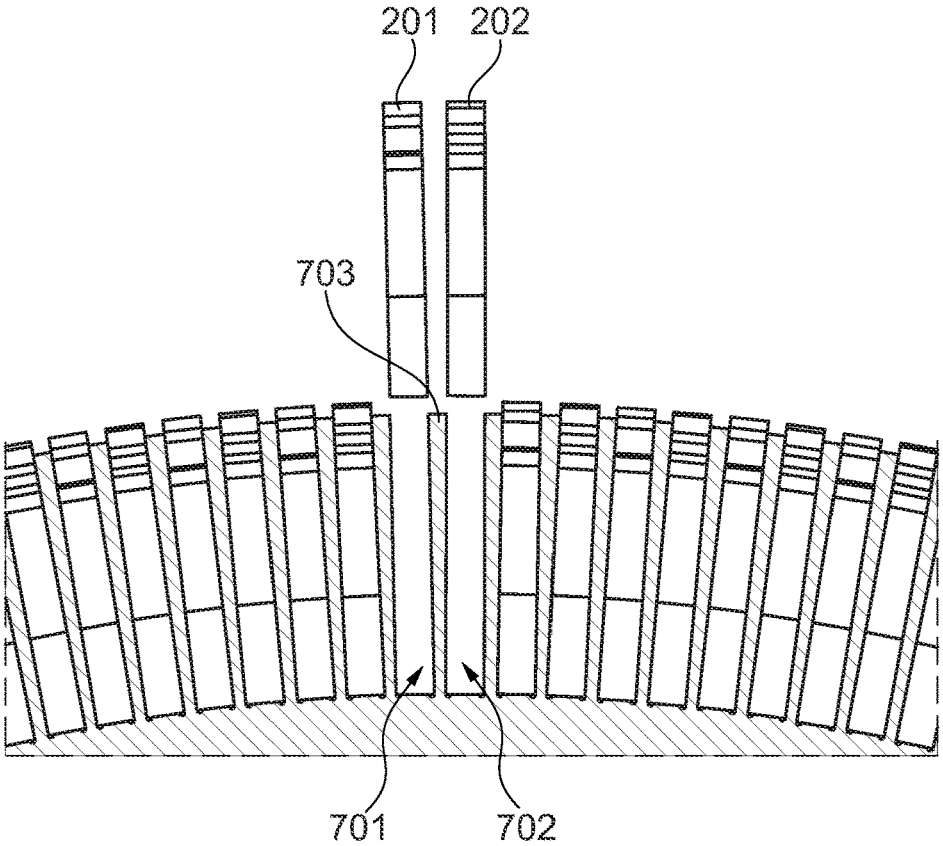
FIGS. 7A and 7B show two views of one way of positioning of the abrasive segments in slots in the hub of the rotary dressing tool.
Figure 7B:
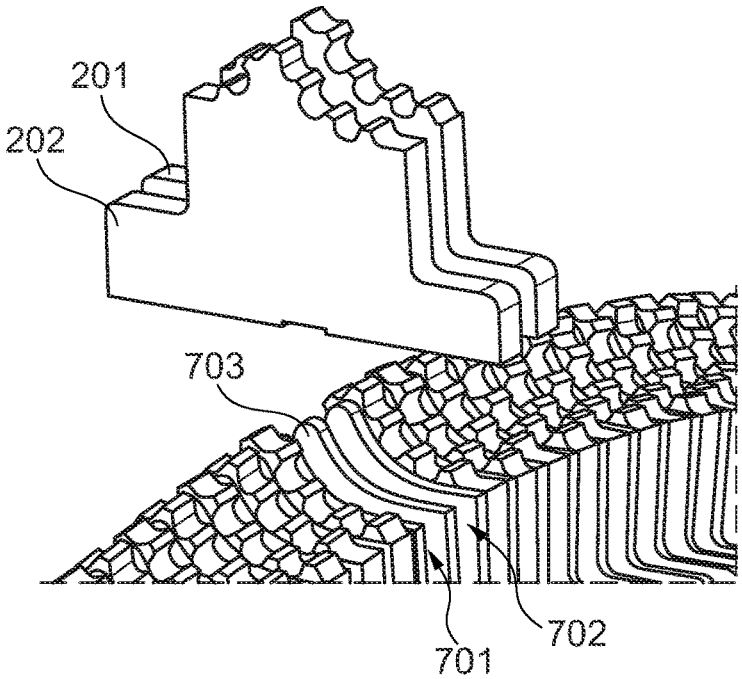

A partial section of the rotary dressing tool 101 along C-C of FIG. 6 is shown in FIG. 7A. A perspective view of the same region is shown in FIG. 7B. In both of these Figures, the abrasive segments 201 and 202 are shown in a removed position.

As described previously, the abrasive segments that form the abrading surface 102 are mounted in the hub 103. This is achieved in the present example by the provision of a plurality slots in the outer circumference of hub, such as a first slot 701 and a second slot 702. The hub 103 may therefore be considered as having a plurality of radial supports between the slots, such as support 703 between slot 701 and slot 702 which separates the abrasive segments 201 and 202 when they are inserted into their respective slots.

It should be noted that this is only one way of assembling the abrasive segments. In another arrangement, the hub may not have slots, but the abrasive segments may be directly stacked adjacent each other and retained in the radial and axial position, for example via tabs and retaining rings. Optionally, the abrasive segments may be mounted on the hub via a permanent fixing process such as brazing, adhesive bonding et cetera.

In the present example, the slots are axially-oriented radial slots. They therefore have their narrowest dimension in the direction orthogonal to the axial and radial directions of the rotary dressing tool 101. The slots are dimensioned such that abrasive segments having tabs fit within them, such as first abrasive segment 201 and second abrasive segment 202.

In a specific example, the hub 103 and the radial slots include channels and holes (not shown) for delivery of cooling fluid and/or lubricant or gas (CO2, LN, air) to the interface of the abrading surface 102 and the grinding wheel undergoing dressing, or grinding in case of a grinding tool/wheel.

Referring to FIG. 7B, it may be seen that in the plane coincident with the axial and radial directions, each radial support, for example support 703, generally conforms in the present example to the shape of the abrasive segments, same for the abrading edge itself. In this way, the abrasive segments are supported over a substantial portion of their surface area by the supports on the hub 103. In the present example, given the dimensions of the slots and abrasive segments match, the combination of the hub and abrasive segments create a substantially solid whole around the circumference of the rotary dressing tool 101.

Thus, in use, as an abrading edge of a particular abrasive segment is drawn over a grinding wheel during a dressing operation, the friction therebetween causes a force to be exerted upon the abrasive segment in a direction opposite to the direction of rotation of the rotary dressing tool 101. This force is transmitted as a compressive load upon the adjacent support, and in turn through to the next abrasive segment, et cetera, around the circumference of the rotary dressing tool 101.

It will be appreciated that unlike in prior art rotary dressing tools, which typically have a steel hub to facilitate electroplating of diamond grits thereto, the hub 103 may be made of a material selected for light weight rather than for compatibility with the electroplating process. Thus in the present example, the hub 103 is an aluminium hub. The slots may be produced in such a hub by a process of wire electrical discharge machining or die sink electrical discharge machining or any other machining process. Alternatively, the hub may be made of a composite material such as a carbon-fibre reinforced plastics material to reduce weight further.

Alternatively the hub may be made by an additive manufacturing process. This may help to improve hub design for segment retention, tool accuracy, coolant delivery and to reduce weight further.

Given the axial orientation of the radial slots in the outer circumference of the hub, the abrading edges of the abrasive segments are oriented in the axial direction. This allows the adoption, if required, of complex profile geometries for the abrading edges. In practice, the profile of the abrading edge will be particular to the geometry of the grinding wheel the rotary dressing tool 101 will dress. For example, the profile of the abrading edge may be parallel, or alternatively not parallel to with the tab 401 and thus the axis A-A. Further, the profile may follow a straight or a curved path or a combination thereof.

Figure 8A:
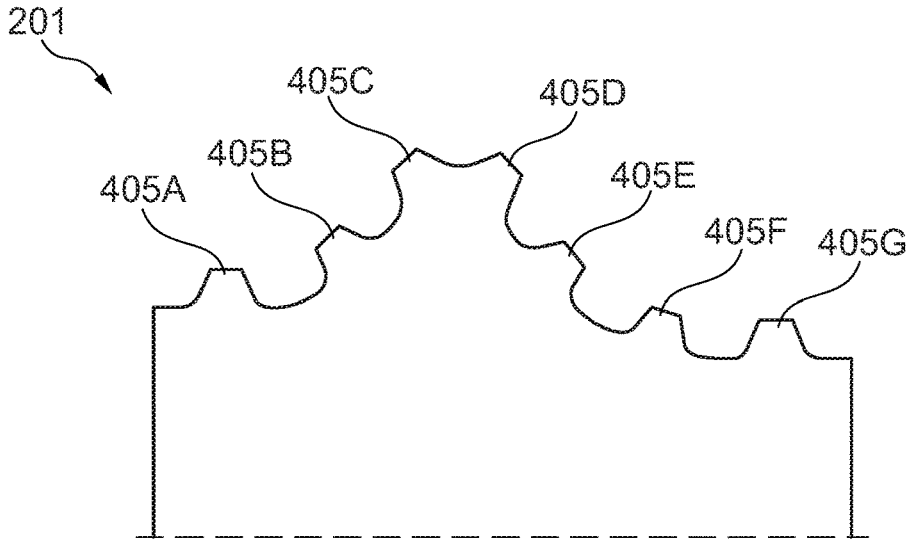
FIG. 8A identifies individual abrasive elements on the abrading edge of an abrasive segment.

A magnified view of the first abrasive segment 201 is shown in FIG. 8A, identifying each abrasive element individually. Thus the first abrasive segment 201 has abrasive elements 405A, 405B, 405C, 405D, 405E, 405F, and 405G.

Figure 8B:
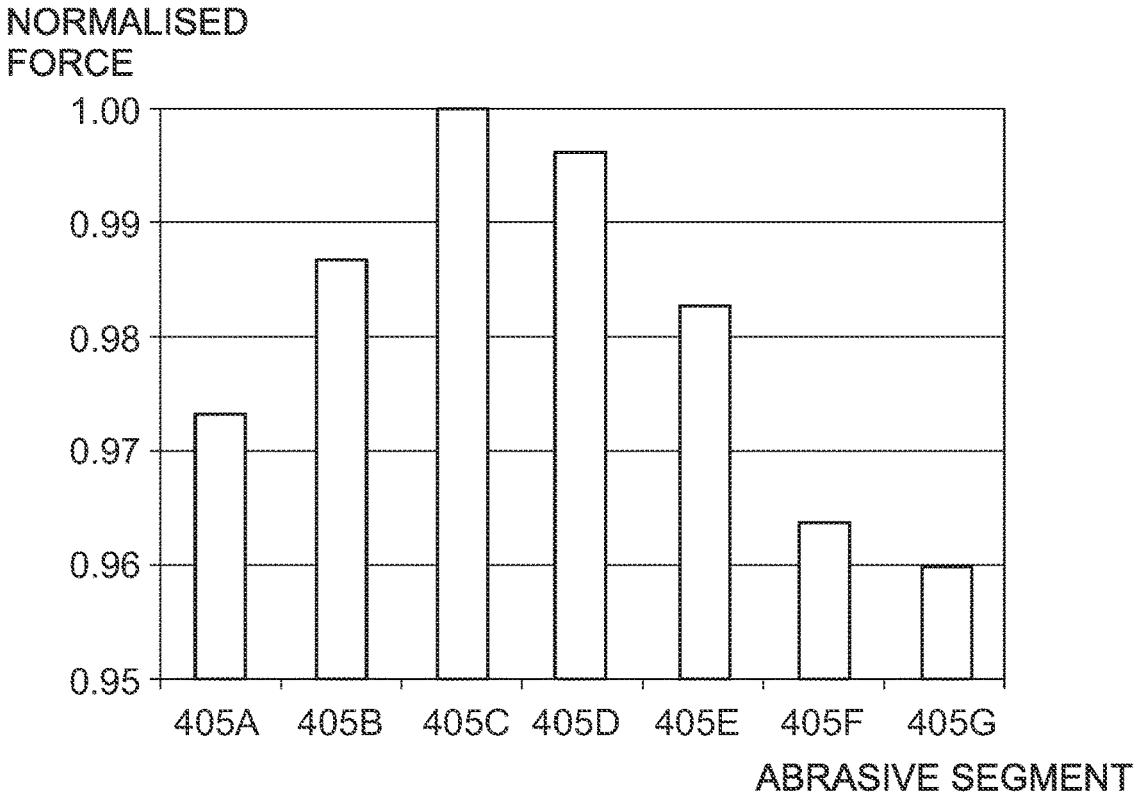
FIG. 8B shows the normalised force experienced by the abrasive elements identified in FIG. 8A.

A plot of the force experienced by each abrasive element is shown in FIG. 8B, with the abscissa identifying the particular abrasive element and the ordinate being the normalised force experienced. The greater force is due to the variation in local radius resulting in greater speed, as, for example, abrasive elements 405C and 405D are further from the axis A-A than abrasive elements 405A and 405G.

The variation of force due to radius results in, for a fixed size of abrasive element 405, different stress conditions depending upon the distance from the tab 401.

Figure 9A:
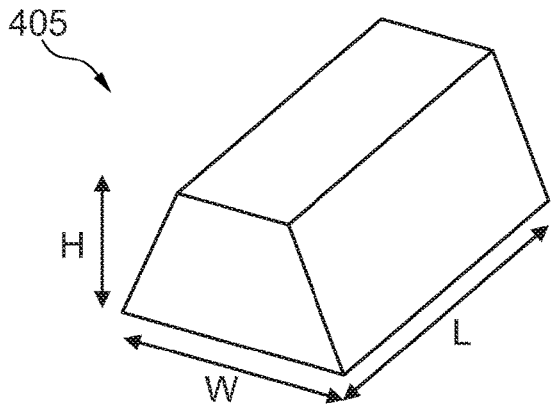
FIG. 9A identifies the dimensions of the abrasive elements.

The stress σ experienced by an abrasive element 405 may be considered as the force F over its base area A, which, referring to FIG. 9A, is the dimension L multiplied by the dimension W, i.e. $\sigma=FA^{-1}$. In the present example, the abrasive elements 405 further from the tab 401 are adapted to withstand greater stress conditions than those closer to the tab. For example, one or more of dimension L and W may be varied to achieve the same stress value for each abrasive element.

In a specific example, the width W of the abrasive elements 405 is varied such that the further an abrasive element 405 is from the tab 401, the wider it is. In alternative examples, only the dimension L may be varied, or both the dimension W and the dimension L may be varied.

Alternatively, other measures may be taken to adapt the abrasive elements to withstand greater stress, such as a change in geometry.

Figure 9B:
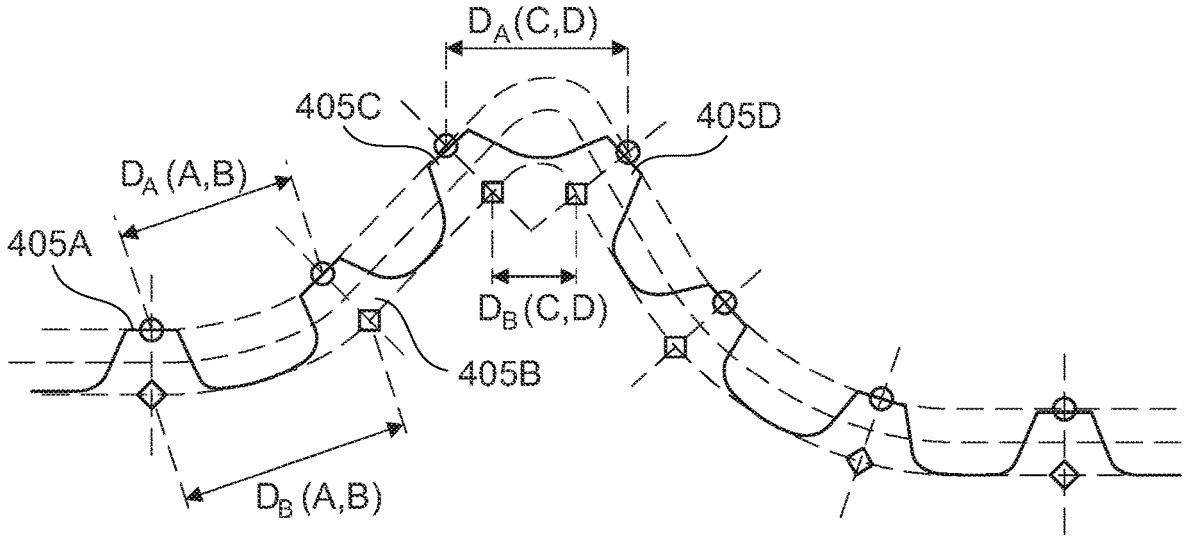
FIG. 9B identifies the variation in distances between the abrasive elements.

FIG. 9B illustrates a further measure which is employed in the present example to increase wear resistance. In particular, the distance $D_A$, in this example the Euclidian distance, between the centres of the abrading surface of the abrasive elements 405 is held constant. Thus the distance $D_A$(A,B) between the centres of the abrading surface of the abrasive elements 405A and 405B is the same as the distance $D_A$(C,D) between the centres of the abrading surface of the abrasive elements 405C and 405D.

This has the result of causing the Euclidian distance $D_B$ between the bases of the abrasive elements 405 to be reduced in areas of low radius of curvature and thus higher density of abrasive elements 405. This can be seen clearly in FIG. 9B, in which the Euclidian distance $D_B$(A,B) between the centres of the bases of abrasive elements 405A and 405B is substantially larger than the distance $D_B$(C,D) between the bases of abrasive elements 405C and 405D. In this way, the wear resistance of the abrasive segments is improved.

Figure 10:
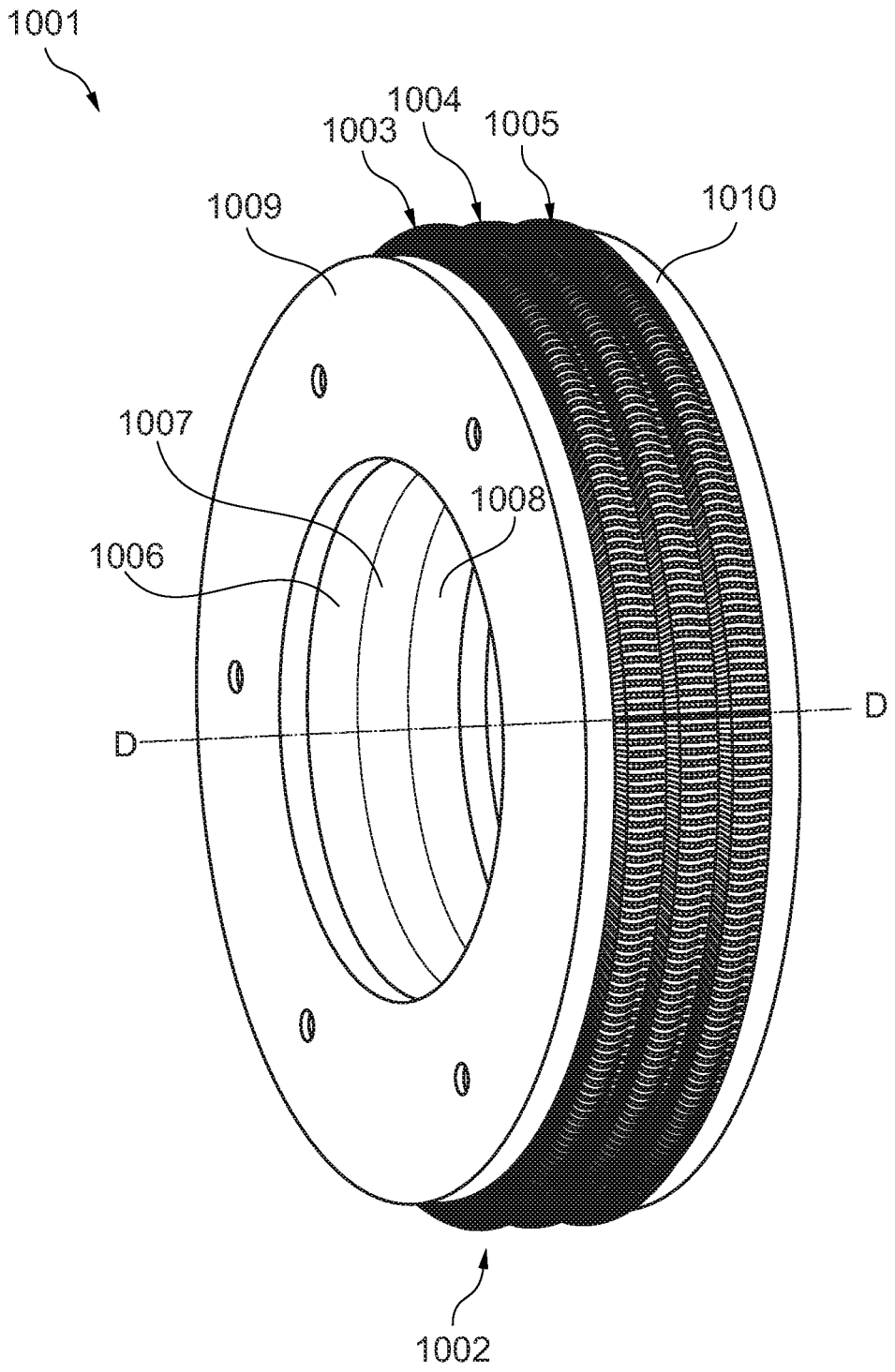
FIG. 10 shows a second example of a rotary abrasive machining tool according to the present disclosure, again in the form of a rotary dressing tool.

A second example of a rotary abrasive machining tool according to an aspect of the present disclosure is shown in FIG. 10. In the illustrated example, the rotary abrasive machining tool is again a rotary dressing tool 1001. As discussed previously however, it will be appreciated that it could instead be configured as a grinding wheel or any other form of rotary abrasive machining tool.

Rotary dressing tool 1001, like rotary dressing tool 101, is generally annular around an axis D-D, and includes an abrading surface 1002. In this example, however, the abrading surface 1002 is larger in axial extent than the abrading surface 102, and is made up of a single or a plurality—three in this example—of axially-adjacent sets 1003, 1004, and 1005 of abrasive segments mounted on respective hubs 1006, 1007, and 1008. As with rotary dressing tool 101, two flanges 1009 and 1010 are provided to sandwich the sets of abrasive segments and the hubs.

Figure 11:
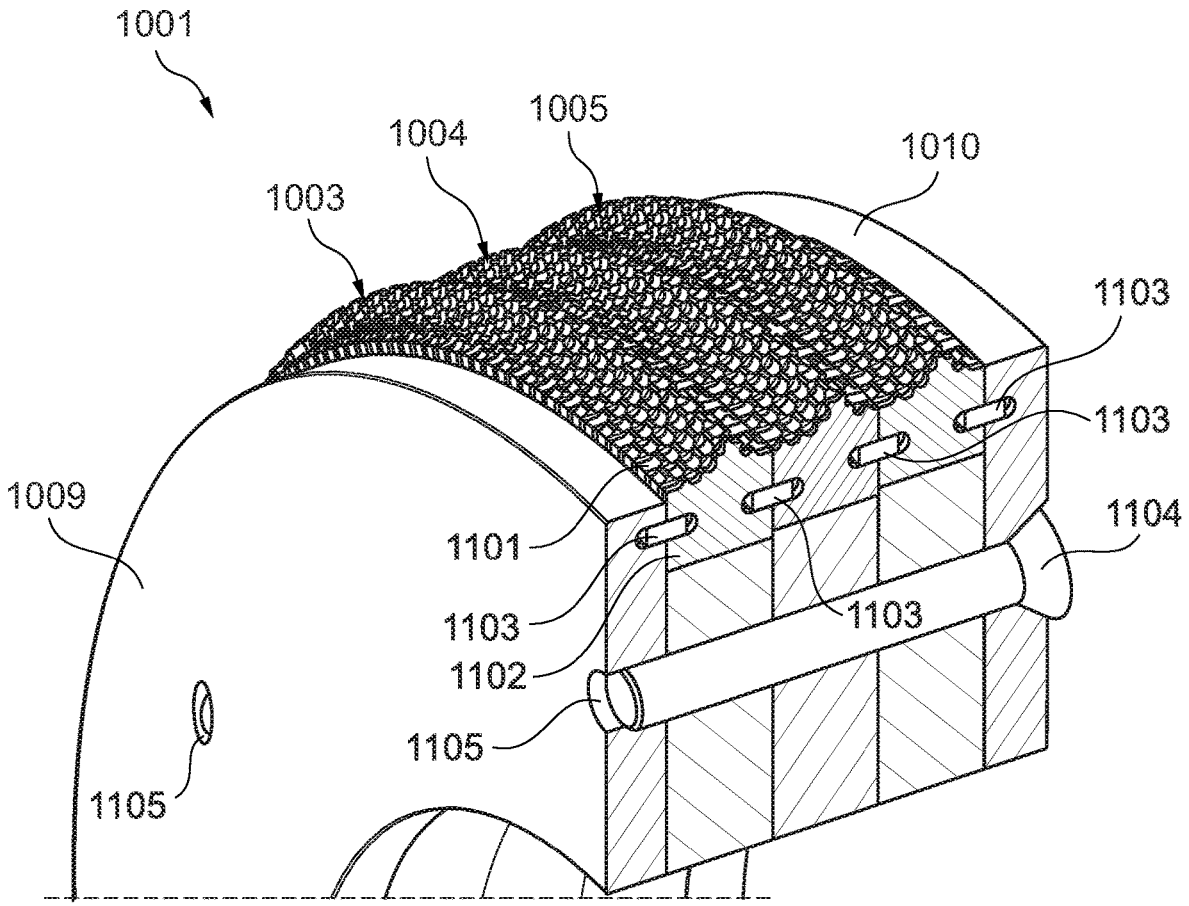
FIG. 11 shows a cutaway of the rotary dressing tool of FIG. 10.
Figure 12:
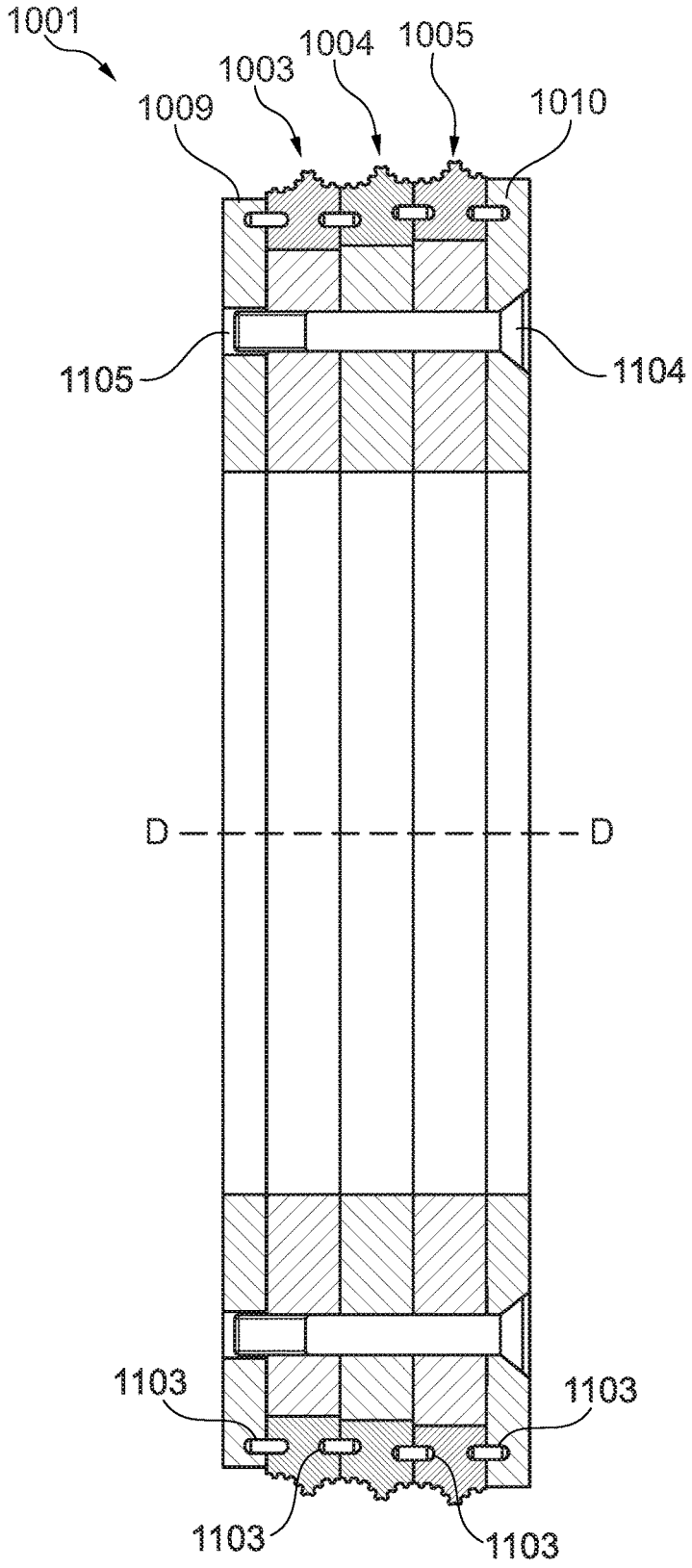
FIG. 12 shows a section along the axial-radial plane of the rotary dressing tool of FIG. 10.

A partial cutaway of the rotary dressing tool 1001 is shown in FIG. 11, and a section in the axial-radial plane is shown in FIG. 12.

In the present example, each set 1003, 1004, and 1005 of abrasive segments comprise a plurality of abrasive segments such as first abrasive segment 1101 and second abrasive segment 1102. These are substantially similar to the abrasive segments 201 and 202 of the rotary dressing tool 101, and thus in the present example, in each set, each abrasive segment has abrasive elements that are axially offset relative to the abrasive elements on the next abrasive segment around the circumference.

Each hub 1006, 1007, and 1008 is similar in configuration to the hub 103 of the rotary dressing tool 101, in that they each include a plurality of axially-oriented radial slots (not shown) in their outer circumference for receiving the abrasive segments.

The abrasive segments are retained in the hub by rings 1103. It will be seen from FIGS. 11 and 12 that the abrasive segments each include a cutout on either side in which the rings 1103 are received. The outermost rings are received in similar cutouts in the inner edges of the flanges 1009 and 1010. In this way, radial movement of the abrasive segments is prevented.

Axial movement is prevented by the flanges, which are held together by a plurality of bolts 1104 whose heads are retained in countersunk holes the flange 1010, and which thread into a threads 1105 in the flange 1009.

In the present example, the rotary dressing tool 1001 is adapted to dress a grinding wheel that will in turn grind a fir tree profile in the root of a turbine blade for a gas turbine engine. As will be appreciated, a fir tree profile comprises a plurality of flanks on opposite sides of a root, which converges towards an apex.

To facilitate generation of this profile with the minimum different types of parts, in the present example the sets 1003, 1004, and 1005 of abrasive segments are identical. However, this is not necessarily the case. The profile of the abrasive segments, may be such that the height at one side is lower than at the other. Thus when placed next to each other, with the profile ends aligned, the bottom surfaces of the segments are offset. Thus, in the present example, the hubs 1006, 1007, and 1008 are each of progressively greater diameter. Thus, in the present example, there is only a requirement for two types of abrasive segments to be machined. Some examples may require only one type of abrasive segment.

It will be appreciated of course that the abrasive segments in each set may have different profiles, thus facilitating the dressing of grinding wheels with more complex geometry.

A third example of a rotary abrasive machining tool according to an aspect of the present disclosure is shown in FIGS. 13A to 13E. In the illustrated example, the rotary abrasive machining tool is a rotary dressing tool 2101. As discussed previously however, it will be appreciated that the rotary abrasive machining tool could instead be configured as a grinding wheel or any other form of such a tool.

The rotary dressing tool 2101 is generally of annular form for location upon a rotary dressing machine, and thus has a rotational axis similar to that of the previous examples. As in the previous examples, the rotary dressing tool 2101 comprises an abrading surface concentric around on a hub 2103.

In use, the rotary dressing tool 2101 is mounted upon a shaft of a rotary dresser machine whereupon it may facilitate dressing of a grinding wheel. In an alternative example, in which the rotary dressing tool 2101 is instead a grinding wheel, it would be mounted upon a shaft of a grinding machine to facilitate grinding of a component.

In an alternative example, in which the rotary dressing tool is instead an abrasive milling tool e.g. with a relatively small diameter and relatively wide abrasive surface on a cylinder, the tool may be held in a tool holder held in the spindle of a grinding machine to facilitate abrasive milling of a component.

Figure 13A:
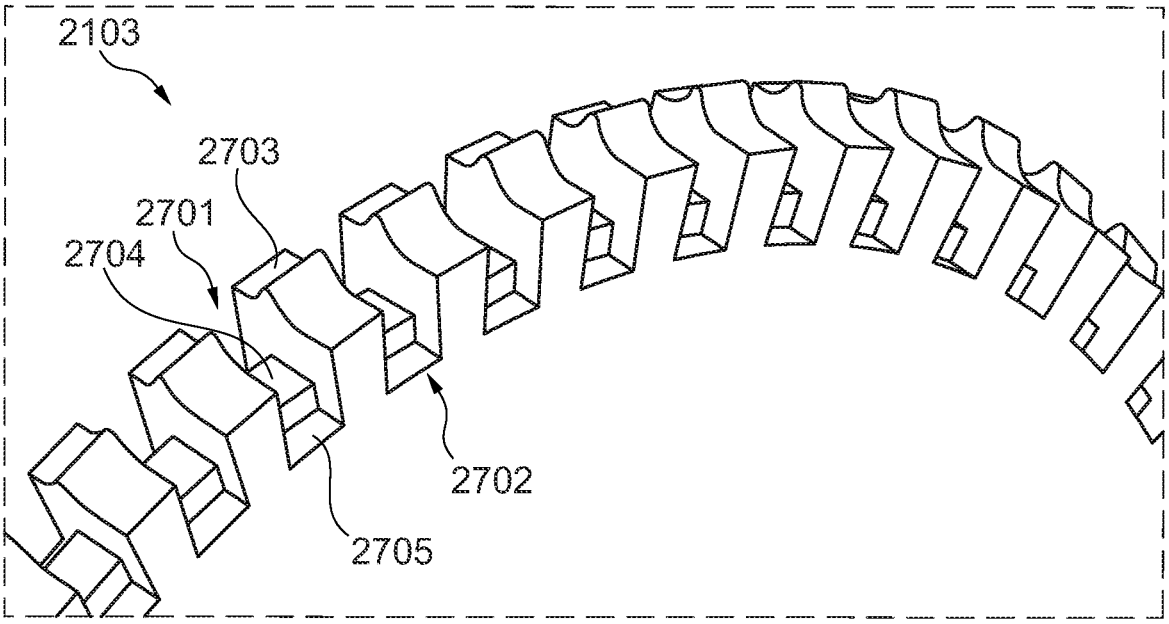
FIG. 13A shows a perspective view of a hub of a third example rotary dressing tool.
Figure 13B:
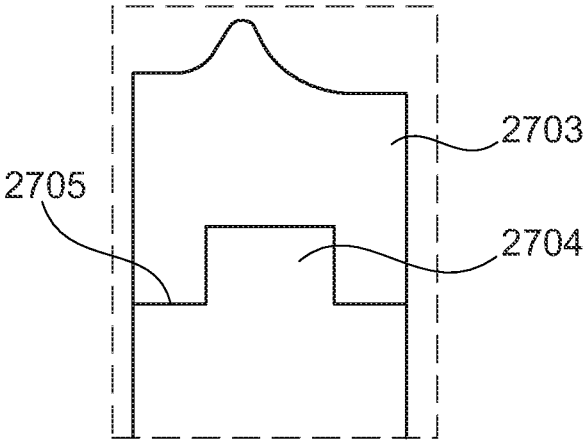
FIG. 13B shows a cross-sectional view through the hub of FIG. 13A.

FIG. 13A shows a perspective view the hub 2103 of the present example. The abrasive segments 2201 are not shown in FIG. 13A. FIG. 13B shows a cross-sectional view through a portion of the hub 2103 at which the abrasive segments are mounted.

The abrasive segments that form the abrading surface of the rotary dressing tool 2101 are mounted on the hub 2103. As in the previous examples, this is achieved in the present example by the provision of a plurality slots in the outer circumference of hub, such as a first slot 2701 and a second slot 2702. The hub 2103 may therefore be considered as having a plurality of radial supports between the slots, such as support 2703 between slot 2701 and slot 2702. The supports separate the abrasive segments when they are inserted into their respective slots.

In the present example, the slots are axially-oriented radial slots. They therefore have their narrowest dimension in the direction orthogonal to the axial and radial directions of the rotary dressing tool 2101. The slots are dimensioned such that abrasive segments having tabs fit within them.

In a specific example, the hub 2103 and the radial slots include channels and holes (not shown) for delivery of cooling fluid and/or lubricant or gas (CO2, LN, air) to the interface of the abrading surface and the grinding wheel undergoing dressing to clean the debris, cool the surface and reduce friction.

As in the first example, in the plane coincident with the axial and radial directions, each radial support, for example support 2703, generally conforms in the present example to the shape of the abrasive segments, save for the abrading edge itself. In this way, the abrasive segments are supported over a substantial portion of their surface area by the supports on the hub 2103. In the present example, given the dimensions of the slots and abrasive segments match, the combination of the hub and abrasive segments create a substantially solid whole around the circumference of the rotary dressing tool 2101.

Thus, in use, as an abrading edge of a particular abrasive segment is drawn over a grinding wheel during a dressing operation, the friction therebetween causes a force to be exerted upon the abrasive segment in a direction opposite to the direction of rotation of the rotary dressing tool 2101. This force is transmitted as a compressive load upon the adjacent support, and in turn through to the next abrasive segment, et cetera, around the circumference of the rotary dressing tool 2101.

In the present example, the hub 2103 is an aluminium hub. The slots may be produced in such a hub by a process of wire electrical discharge machining, die sink electrical discharge machining or other processes. Alternatively, the hub may be made of a composite material such as a carbon-fibre reinforced plastics material to reduce weight further.

As shown in FIGS. 13A and 13B the slots of this example, for example slots 2701 and 2702, comprise a protrusion extending in a radial direction from a lower surface 2705 of the slot. As will be described further below, the protrusion is for positioning the abrasive segment in the slot. Multiple protrusions may be provided in other examples. The protrusion 2704 shown in FIGS. 13A and 13B extends across the full width (dimension in a circumferential direction of the tool 2101) of the slot, such that is it contiguous with (e.g. integral with) the supports adjacent to it. However, this need not be the case. For example the protrusion 2705 may be contiguous with only one adjacent support, or neither adjacent support.

Figure 13C:
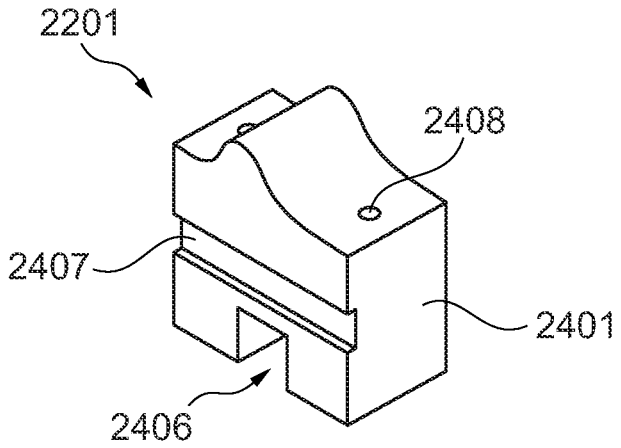
FIG. 13C shows an abrasive segment of the third example rotary dressing tool.

An example abrasive segment 2201 is shown in isolation in FIG. 13C.

Each abrasive segment includes a tab 2401 for mounting the abrasive segment in the hub 2103. Unlike in the first example, in the present example, the tab 2401 has a substantially uniform length in an axial direction of the tool 2101. Each abrasive segment also comprises a respective abrading edge, having a specific controlled profile. The abrading edge may be substantially as described above in relation to the first example. However, FIG. 13C shows the abrasive segment before the abrading edge has been machined.

In the present example, the abrasive segments comprise a recess 2406 in a lower face thereof. The recess 2406 corresponds to the protrusion 2704 of the hub 2103, as described above. The protrusion 2704 and the recess 2406 are configured to mate in order to locate the abrasive segment 2201 in the hub 2103. As mentioned above, multiple protrusions may be provided in each slot, in which case multiple corresponding recesses may be provided in the abrasive segment 2201.

In other examples, the hub may include recesses and the abrasive segments may include protrusions, or each may include a combination of recesses and protrusions.

In other examples, the hub may include a plain cylindrical outer surface with corresponding plain abrasive segments which are either non-permanently fixed to the hub (e.g. by retention rings) or permanently fixed to the hub (e.g. by brazing, adhesives et cetera).

As shown in FIG. 13C, the abrasive segment 2201 of the present example also includes a channel 2407. The channel 2407 is shown to be provided in a circumferentially facing face of the abrasive segment 2201 and extends axially. Channels may also be provided in the other circumferentially facing face and/or one or both axially facing faces of the abrasive segment 2201. The channel is configured to accommodate a fastening means, which will be described further below.

The abrasive segment shown in FIG. 13C also includes a hole, which form an entrance to a channel 2408 passing through the segment in a radial direction. Two channels are provided in this example, but any number, shape and orientation may be provided. The channels are configured to provide cooling and/or lubricating fluid or gas (CO2, LN or air) to the abrading surface.

Figure 13D:
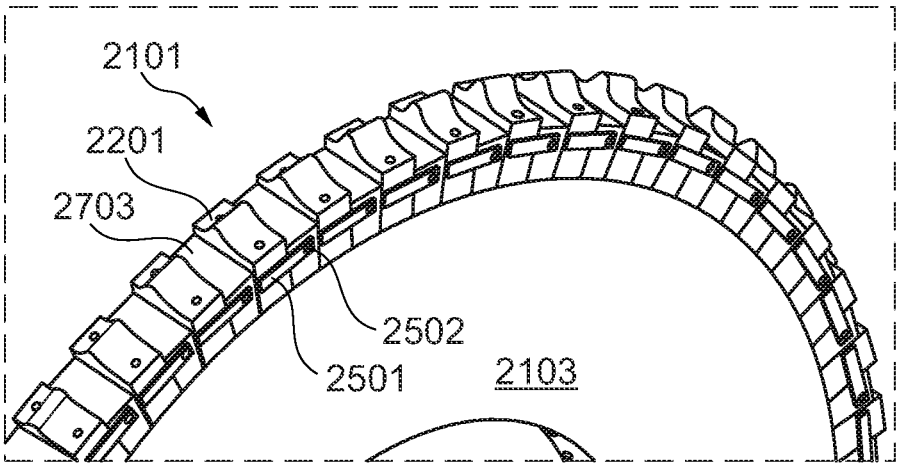
FIG. 13D shows a perspective view of the third example rotary dressing tool.

FIG. 13D shows the rotary dressing tool 2101 with a plurality of abrasive segments, such as abrasive segment 2201, mounted to the hub 2103 within the slots and separated by the supports, such as support 2703. In this example, one abrasive segment is provided in each slot. However multiple abrasive segments may be provided in each slot instead.

In the present example, the abrasive segments, such as segment 2201, are secured in each slot by a fastening strip 2501. The fastening strips are attached either side of the abrasive segments within a slot (in an axial direction) in order to prevent axial displacement of the abrasive segments. The strips are attached to at least one support by a fastening means 2502, such as a screw, bolt or rivet. Corresponding holes (e.g. tapped holes) may be provided in the supports to receive the fastening means.

In the present example, the fastening strips are U-shaped and arranged to surround abrasive segments within each slot on three sides, two sides facing axially and one side facing circumferentially. Further, in this example, the fastening strip is located in the channel 2407 of the abrasive segment. This prevents radial displacement of the abrasive segment within the slot.

Figure 13E:
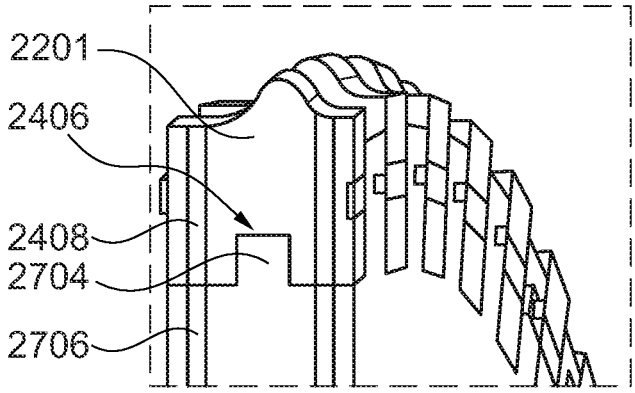
FIG. 13E shows a cross-section through the third example rotary dressing tool.

FIG. 13E shows a cross-section through the rotary dressing tool 2101 shown in FIG. 13D. The cross-section is in an axial-radial plane and bisects the abrasive segment 2201. The engagement between the protrusion 2704 and the recess 2406 can be seen.

Further, FIG. 13E shows the channels, such as channel 2408, in the abrasive segment. It can be seen that the hub also comprises channels, such as channel 2706 which connects with channel 2408 to provide the cooling and/or lubricating fluid or gas (CO2, LN, air) thereto. The channel 2706 passes through the hub in a radial direction.

Figure 14A:
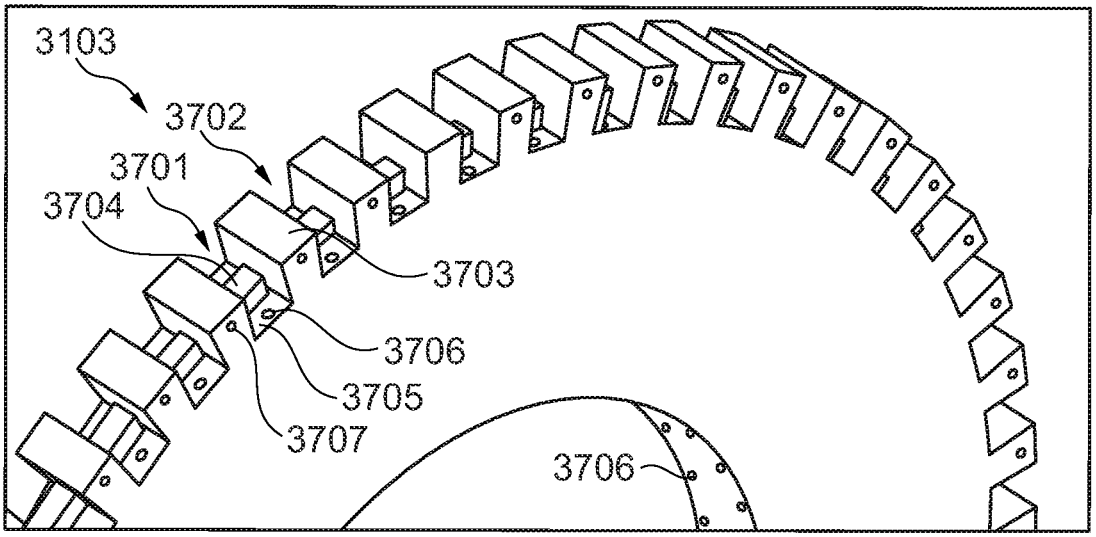
FIG. 14A shows a perspective view of a hub of a fourth example rotary dressing tool.
Figure 14B:
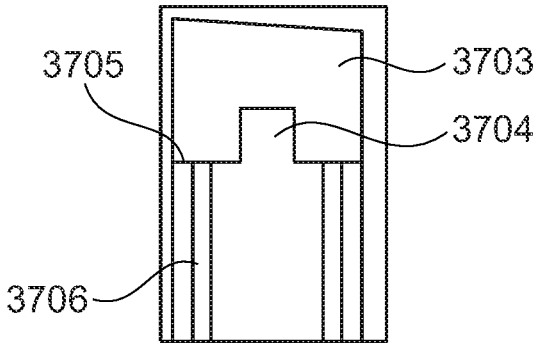
FIG. 14B shows a cross-sectional view through the hub of FIG. 14A.

A fourth example of a rotary abrasive machining tool according to an aspect of the present disclosure is shown in FIGS. 14A and 14B. In the illustrated example, the rotary abrasive machining tool is a rotary dressing tool. As discussed previously however, it will be appreciated that the rotary abrasive machining tool could instead be configured as a grinding wheel or any other form of such a tool.

FIG. 14A shows a perspective view the hub 3103 of the present example. The abrasive segments 3201 are not shown in FIG. 14A. FIG. 14B shows a cross-sectional view through a portion of the hub 3103 at which the abrasive segments are mounted.

The abrasive segments that form the abrading surface of the rotary dressing tool of the present example are mounted on the hub 3103. As in the previous examples, this is achieved in the present example by the provision of a plurality slots in the outer circumference of hub, such as a first slot 3701 and a second slot 3702. The hub 3103 may therefore be considered as having a plurality of radial supports between the slots, such as support 3703 between slot 3701 and 3lot 2702. The supports separate the abrasive segments when they are inserted into their respective slots.

As shown in FIGS. 14A and 14B, the slots may comprise a protrusion 3704 extending in a radial direction from a lower surface 3705 of the hub defining the slot. These are the same as those described above in relation to the second example tool.

FIGS. 14A and 14B also show channels 3706 in the hub 3103, such as those discussed above, for providing cooling fluid and holes 3707 for receiving a fastening means for securing the abrasive segments in the slots.

The primary difference between the present example tool and the third example tool is in the profile of the supports, such as support 3703. Whereas the support 2703 of the previous example has a curved profile, the support 3707 of the present example has a planar profile, i.e. it has a substantially flat surface. As can be seen in FIG. 14B, the planar profile may be sloped in an axial direction.

In the above examples, instead of a solid cylindrical hub as shown, the hub may comprise features such as, slots, holes, grooves, and/or tracks. These may be formed by machining a solid hub. Alternatively, the hub may be manufactured by an additive manufacturing process.

The hub may be made from low alloy steel or other material such as alternative metallic materials, carbon fibre, ceramic or a combination of these.

The present disclosure provides a method of manufacturing a rotary abrasive machining tool comprising a hub and a plurality of abrasive segments mounted to the hub, such as the example tools described above. In the method, an abrading edge is machined on each abrasive segment, while said abrasive segment is mounted on the hub.

The abrasive segments may be produced by obtaining a blank of material for the abrasive segment, and then machining the abrasive segment from the blank. In a specific example, the machining process comprises electrical discharge machining. Alternatively, pulsed laser ablation, water jet cutting, or any other suitable machining process may be used to machine the abrasive segments from the blanks. Several blanks may be stacked and machined together.

Figure 15A:
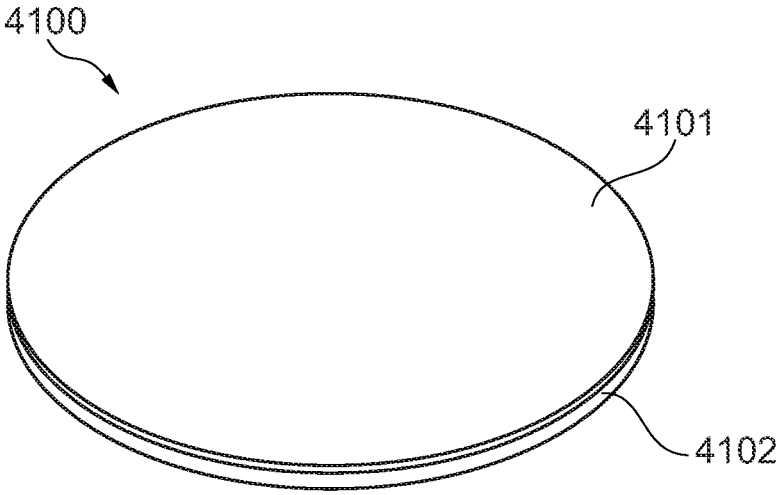
FIGS. 15A and 15B respectively show a perspective view and a side view of a blank for an abrasive segment.
Figure 15B:
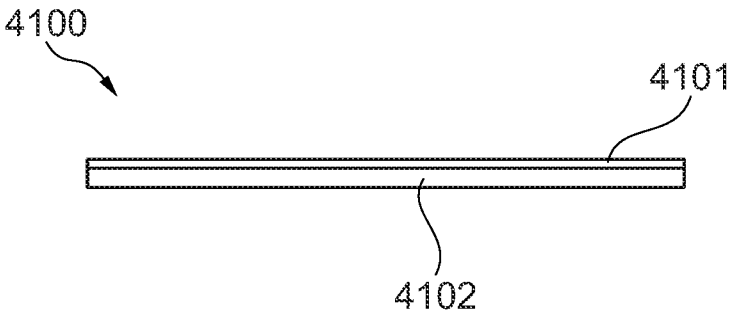

FIGS. 15A and 15B show an example of a blank 4100 for forming an abrasive segment. As shown, the blank 4100 may be formed as a stack comprising a layer of abrasive material 4101 on a substrate 4102. The blank 4100 is shown in cylindrical shape, but any shape blank may be used.

The abrasive material may be a diamond, such as polycrystalline diamond (PCD). Alternatively, the abrasive material is another form of diamond, or another substance such as cubic boron nitride (e.g. polycrystalline cubic boron nitride), or carbide (coated or uncoated). The substrate material may be tungsten carbide (WC). Alternatively, the substrate material may be hard metal.

Figure 16A:
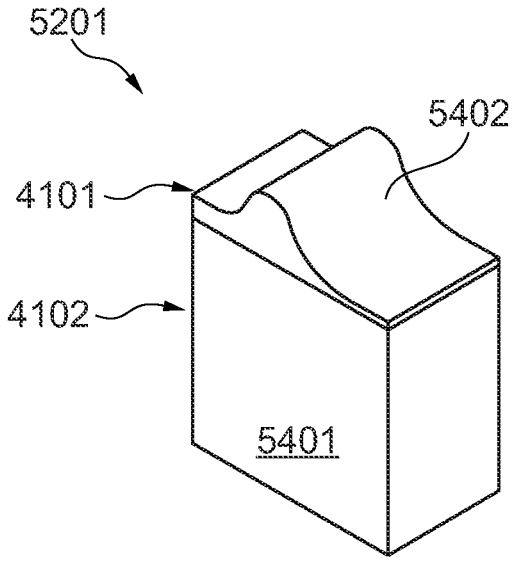
FIGS. 16A and 16B show perspective views of abrasive segments formed from blanks having respective orientations.
Figure 16B:
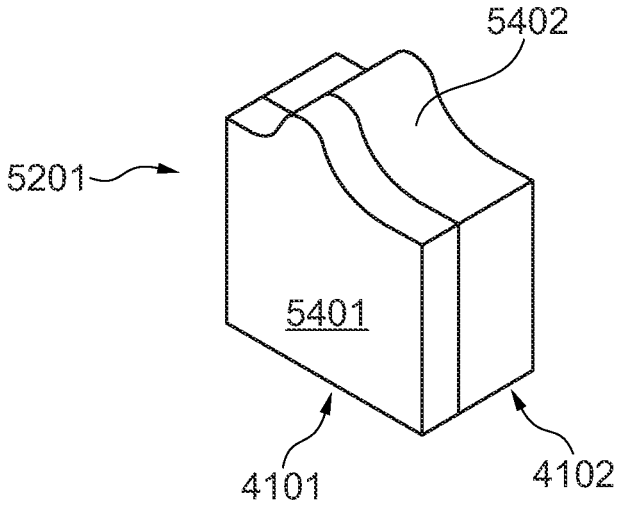

FIGS. 16A and 16B show abrasive segments formed from a blank. As shown, stack of abrasive material 4101 and substrate material 4102 may be orientated in a number of directions.

For example, as shown in FIG. 16A, the stacking direction of the layers may be arranged in a radial direction of the abrasive machining tool. Alternatively, as shown in FIG. 16B, the stacking direction of the layers may be arranged in a circumferential direction of the abrasive machining tool. Any angle in between is also possible, i.e. a stacking direction oblique to the radial direction and the circumferential direction. Orientation of the stack may be chosen to suit each specific tool application.

The abrasive segments may be formed from the blanks to a near finished profile before mounting on the hub, leaving some machining stock for fine finishing of detailed abrasive features of the abrading edge, e.g. abrasive elements 405. This near-finish machining step should ensure that enough abrasive material is left for the precision finishing of the abrading edge, once the abrasive segment is mounted to the hub.

Additional features of the abrasive segments, such as those for locating the abrasive segments on the hub, securing the abrasive segments on the hub, or providing cooling and/or lubricating fluid are preferably also machined prior to machining the abrading edge.

Once an abrasive segment is obtained, e.g. formed from the blank, it may be mounted on the hub. The method of mounting depends on the specific rotary abrasive machining tool. Any of the methods described above in relation to the four example tools described may be used, for example.

Alternatively, abrasive segments may be fastened directly to the hub by one or more fastening means, such as screws, bolts or rivets (through corresponding holes in the segments and the hub). Alternatively, a permanent fastening method, such as brazing or adhesive bonding, may be used to fasten individual abrasive segments to the hub.

As described above, an abrading edge is machined on each abrasive segment, while said abrasive segment is mounted on the hub. The abrading edge may be machined by ablation. One method of ablation which may be used is laser ablation. Alternative methods are also possible, for example: electrical discharge machining (EDM), electrical chemical machining (ECM), laser scribing or laser lapping. In alternative designs, an additive manufacturing method could be used to generate an abrading edges on each abrasive segment.

Figure 17A:
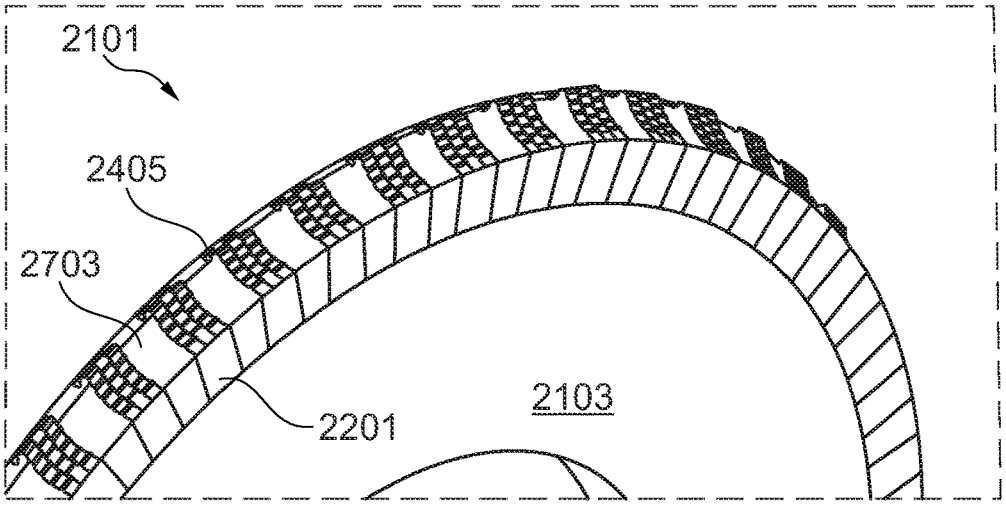
FIGS. 17A and 17B show perspective views at different magnifications of abrading edges of the third example rotary dressing tool.
Figure 17B:
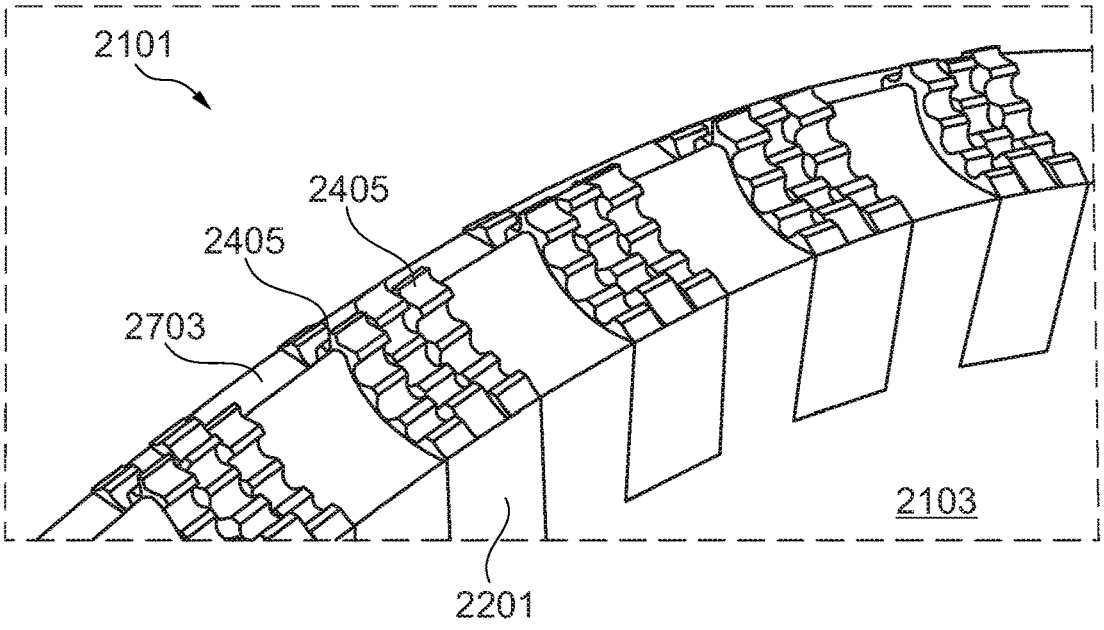

FIGS. 17A and 17B show the machined abrading edge of the fourth example tool, for illustration. FIG. 17B is a magnified view of FIG. 17A.

As shown in FIGS. 17A and 17B, multiple (e.g. three) abrading edges may be machined onto each abrasive segment 2201. Alternatively, only one abrading edge may be machined onto each abrasive segment. Each of the abrading edges may be substantially as described above in relation to the first example abrasive tool.

Regardless of the number of abrading edges on each abrasive segment, adjacent abrading edges may comprise abrasive elements 2405 arranged such that the abrasive elements of one abrading edge are offset with respect to the abrasive elements on an adjacent abrading edge, and vice versa. This is illustrated in FIG. 17B. In particular, it can be seen that the abrading edges of adjacent abrasive segment alternate between a first abrading edge and a second abrading edge.

In a case where multiple abrading edges are provided in each slot of the hub, the last abrading edge in one slot may be the same as the first abrading edge in the next slot, and vice versa. In a case where a single abrading edge is provided in each slot of the hub, such as in the first example tool, the abrading edge in one slot is preferably different to the abrading edge in the next slot.

The method described above may achieve very tight tolerance requirements (order of one micron). This would be extremely difficult to achieve by a method in which the abrasive edge is machined before assembly.

Further, near-finish machining of abrasive segments enables the use of more aggressive machining parameters (high material removal rates). Therefore the disclosed method may be more cost effective than a high precision machining to the finish tolerances of individual 'loose' segments.

A blank made from a PCD-WC stack may increase performance and life of the abrasive segments. The high strength top PCD layer may ensure reduced and controlled wear of the abrasive edges (prolonged retention of a sharp edge), while the backing tungsten carbide substrate may give a tough and strong support to the PCD layer (or PCBN layer in other examples).

WC backing may provide additional support and/or increased resistance to machining forces, this may extend the life of the tool and/or enable a faster and/or more aggressive machining process. Further, the extra support provided by the WC backing also enables a more efficient PCD material utilisation. Therefore, reduced number of abrasive segments may be used.

Fastening individual semi-finished PCD segments to the tool body would eliminate a need for individually manufacturing highly precise rotary tool body and abrasive segments with complex fixing features to their finish tolerances in non-assembled state, which would not only be extremely difficult, time consuming and costly, but would also require highly specialised assembly equipment.

Finally, it will be understood that the disclosure is not limited to the examples above-described and various modifications and improvements can be made without departing from the concepts described herein. Except where mutually exclusive, any of the features may be employed separately or in combination with any other features and the disclosure extends to and includes all combinations and sub-combinations of one or more features described herein.

What is claimed is:

1. A method of manufacturing a rotary abrasive machining tool, the rotary abrasive machining tool comprising a hub and a plurality of abrasive segments mounted to the hub, the method comprising the steps of:

mounting each abrasive segment with a recess on the hub that includes a plurality of protrusions, such that the recess of each abrasive segment is configured to mate with a corresponding one of the plurality of protrusions on the hub; and machining an abrading edge on each abrasive segment while said abrasive segment is mounted on the hub.

2. The method of claim 1, further comprising, prior to mounting each abrasive segment on the hub:

obtaining a blank of material for each abrasive segment;

forming the abrasive segment from the blank.

3. The method of claim 1, in which the abrading edge comprises a plurality of abrasive elements.

4. The method of claim 3, in which:

the abrading edge has a profile upon which each one of the plurality of abrasive elements lies; and each one of the plurality of abrasive elements has an abrading surface that is parallel to the profile of the abrading edge at the location of the respective abrasive element.

5. The method of claim 3, in which each one of the plurality of abrasive elements has an abrading surface, and there is a constant distance between centers of the abrading surfaces.

6. The method of claim 3, in which the abrasive elements on adjacent abrasive segments are axially offset in relation to each other.

7. The method of claim 1, in which the abrading edge of each one of the plurality of abrasive segments has one of:

the same profile;

one of a plurality of different profiles.

8. The method of claim 1, wherein the profile of the abrading edge follows one of:

a straight path; or a curved path.

9. The method of claim 1, in which the abrasive segment comprises an abrasive material of:

cubic boron nitride;

carbide; or diamond.

10. The method of claim 9, in which the abrasive segment comprises a substrate on which the abrasive material is provided.

11. The method of claim 10, wherein the substrate material is tungsten carbide.

12. The method of claim 2, in which the forming of the abrasive segment from the blank is one of:

electrical discharge machining;

pulsed laser ablation;

water jet cutting.

13. The method of claim 1, in which the machining of the abrasive edge is one of:

pulsed laser ablation;

electrical discharge machining;

water jet cutting.

14. The method of claim 1 in which:

the hub has a plurality of axially-oriented radial slots in the outer circumference thereof; and the step of mounting each abrasive segment on the hub comprises locating each abrasive segment in a slot in the hub.

15. The method of claim 13, in which one abrasive segment is mounted in each slot.

16. The method of claim 14, in which the plurality of protrusions are included in the slots, such that the recess of each abrasive segment is configured to engage with the corresponding one of the plurality of protrusions in the slots.

17. The method of claim 14, in which the abrasive segments are retained in the slots by flanges attached either side of the hub.

18. The method of claim 14, in which the abrasive segments are retained in the slots by fastening strips attached either side of the abrasive segments.

19. The method of claim 18, in which the fastening strips are U-shaped, and arranged to surround each abrasive segment on three sides, two sides facing axially and one side facing circumferentially.

20. The method of claim 1, in which the hub comprises a cylindrical outer surface.

21. The method of claim 1, in which the abrasive segments are mounted on the hub via a permanent fixing process.

22. The method of claim 21, wherein the permanent fixing process is one of brazing or adhesive bonding.

23. A method of manufacturing a rotary abrasive machining tool, the rotary abrasive machining tool comprising a hub and a plurality of abrasive segments mounted to the hub, the method comprising the steps of:

mounting each abrasive segment on the hub; and machining an abrading edge on each abrasive segment while said abrasive segment is mounted on the hub, wherein the machining of the abrasive edge is one of:

pulsed laser ablation;

electrical discharge machining;

water jet cutting, and wherein a plurality of abrasive segments are mounted in each slot.

* * * * *